US006235153B1

(12) United States Patent
Uchida et al.

(10) Patent No.: US 6,235,153 B1
(45) Date of Patent: May 22, 2001

(54) METHOD OF PRODUCING A BLEACHED PULP WITH CHLORINE DIOXIDE UNDER A PRESSURE CREATED BY A COMPRESSED GAS CONTAINING OXYGEN

(75) Inventors: Yosuke Uchida; Takahiro Miura; Makoto Iwasaki, all of Tokyo (JP)

(73) Assignee: Oji Paper Co., Ltd., Chuo-ku (JP)

( * ) Notice: Subject to any disclaimer, the term of this patent is extended or adjusted under 35 U.S.C. 154(b) by 0 days.

(21) Appl. No.: 09/143,363

(22) Filed: Aug. 28, 1998

(30) Foreign Application Priority Data

Sep. 1, 1997 (JP) ..... 9-235829

(51) Int. Cl.[7] ..... D21C 9/14; D21C 9/147
(52) U.S. Cl. ..... 162/65; 162/88; 162/89
(58) Field of Search ..... 162/67, 81, 65, 162/68, 88, 89, 87, 63

(56) References Cited

U.S. PATENT DOCUMENTS

| | | | | |
|---|---|---|---|---|
| 2,706,673 | * | 4/1955 | Burling et al. | 162/67 |
| 4,568,420 | * | 2/1986 | Nonni | 162/65 |
| 4,599,138 | * | 7/1986 | Lindahl | 162/84 |
| 5,179,021 | | 1/1993 | du Manoir et al. | 162/72 |
| 5,474,654 | * | 12/1995 | Mendiratta et al. | 162/67 |
| 5,618,386 | | 4/1997 | Arbeloa et al. | 162/72 |
| 5,645,687 | * | 7/1997 | Ambady et al. | 162/89 |

FOREIGN PATENT DOCUMENTS

| | | |
|---|---|---|
| 2-264087 | 10/1990 | (JP) . |
| 4-316689 | 11/1992 | (JP) . |
| 4-316690 | 11/1992 | (JP) . |
| WO 93/15263 | 8/1993 | (WO) . |
| WO 98/00602 | 1/1998 | (WO) . |

OTHER PUBLICATIONS

Cook, "A Bleaching Process for Minimizing AOX Discharges", APPIta, vol. 4, No. 3, pp. 179–183, May 1991.*

Appita Journal, vol. 45, No. 1, Jan. 1992.

Tappi Journal, Jul. 1992, vol. 75, No. 7.

Tappi Proceedings, 1986 Pulping Conference.

Journal of Pulp and Paper Science, "Formation of Chlorinated Organic Material and Chlorate During Chlorine Dioxide Prebleaching of Kraft Pulp: Effects of Sodium Chloride, Charge of Chlorine Dioxide and pH", Gunnarsson et al., vol. 22, No. 12, Dec. 1996.

* cited by examiner

*Primary Examiner*—Steve Alvo
(74) *Attorney, Agent, or Firm*—Arent Fox Kintner Plotkin & Kahn PLLC

(57) ABSTRACT

A bleached pulp having a high brightness and a satisfactory pulp viscosity is produced from a lignocellulosic material with a high efficiency by subjecting an aqueous slurry of a pulp to a bleaching step including at least one stage in which the pulp is bleached with chlorine dioxide under a pressure of, for example, 0.0980 to 0.883 MPa (1.0 to 9.0 kg/cm$^2$), created by a compressed gas, preferably at a pH of 2 to 5, at a temperature of 50 to 120° C. and in a pulp consistency of 5 to 40%.

2 Claims, No Drawings

METHOD OF PRODUCING A BLEACHED PULP WITH CHLORINE DIOXIDE UNDER A PRESSURE CREATED BY A COMPRESSED GAS CONTAINING OXYGEN

BACKGROUND OF THE INVENTION

1. Field of the Invention

The present invention relates to a method of producing a bleached pulp. More particularly, the present invention relates to a method of producing a bleached pulp in which method a pulp prepared from a lignocellulosic substance is bleached with chlorine dioxide, and the chlorine dioxide bleaching procedure is carried out under a pressure created by a compressed gas, whereby not only the delignification and bleaching effect is improved and the amount of bleaching chemicals necessary for bleaching the pulp to a desired brightness is reduced, but also the amount of organic chlorine-containing compounds contained in a waste water is reduced.

2. Description of the Related Art

To employ a lignocellulosic substance as a paper-forming material for various uses, it is necessary that the lignocellulosic substance be pulped by a chemical pulping procedure, for example, a digesting procedure or by a mechanical pulping procedure using, for example, a refiner; and the resultant pulp be bleached with bleaching chemicals to enhance the brightness of the pulp. For instance, kraft pulp is usually (except for the case where the kraft pulp is used, for specific paper sheets, for example, packing paper sheets which need a high mechanical strength) subjected to an alkali-oxygen delignification procedure, and then is bleached with a bleaching chemical and bleaching additive, for example, chlorine, hypochlorite, chlorine dioxide, oxygen, ozone, hydrogen peroxide and sodium hydroxide, whereby the coloring substances such as lignin contained in the pulp are removed, and the delignified pulp is bleached to provide a bleached kraft pulp suitable for practical use.

When a bleached pulp is produced from an unbleached pulp, it is necessary that the mechanical strength of the pulp fibers is maintained as high as possible, and that the hydrolysis of hydrocarbon substances such as cellulose and hemicellulose substances, from which the pulp fibers are constituted, be minimized, and thus usually a vigorous single step bleaching procedure is avoided, and a multi-stage bleaching procedure, for example, a 3 to 6 stage bleaching procedure in which various bleaching chemicals can be used in combination with various bleaching conditions, is carried out under medium conditions.

In the conventional multi-stage bleaching method, the following procedures are practically employed. Namely, firstly, a pulp is treated with chlorine to chlorinate the lignin contained in the pulp and to give solubility to the lignin, then the chlorinated pulp is dissolve-extracted with an aqueous alkali solution to isolate and remove the lignin from the pulp, and finally, the residual lignin in a small amount in the pulp is decomposed and removed by using a hypochlorite or chlorine dioxide, to obtain a bleached pulp having a high brightness.

Recently, however, the environmental influence of organic chlorine-containing compounds (which will be represented by AOX hereinafter) contained the waste water discharged from a pulp-chlorination step in the pulp-bleaching procedure has become a problem, and thus a new method of not using chlorine for bleaching the pulp has been promoted. Also, when a hypochlorite is used, chloroform is generated during pulp-bleaching and there is a risk of affecting the environment. Therefore, a new pulp-bleaching sequence using no hypochlorite is demanded.

Recently, as substitutes for the chlorine-containing bleaching chemicals such as chlorine and hypochlorite, oxygen-containing bleaching chemicals, for example, ozone, oxygen, hydrogen peroxide and peracids, for example, peracetic acid and persulfonic acid, and salts of the peracids have drawn the pulp-bleaching industry's attention. These oxygen-containing bleaching chemicals except for oxygen and hydrogen peroxide are, however, disadvantageous in that they exhibit a low selectivity to the delignification and thus a high risk of decreasing the mechanical strength of the pulp, the prices thereof are high, and the chemical handling is difficult because there is a risk of explosion. Due to the above-mentioned disadvantages, the utilization of oxygen-containing bleaching chemicals has not yet become wide-spread. Therefore, in the present stage, as a substitute for chlorine and hypochlorite, chlorine dioxide, of which the practical use result is known, is generally employed. Particularly, in practice, the frequence of replacement of chlorine-bleaching with the chlorine dioxide-bleaching is now increasing. However, since the mechanism of the delignification with chlorine dioxide is different from that with chlorine, the chlorine dioxide must be used in an increased amount or bleaching chemicals in other bleaching stages must be used in a large amount, to obtain the same degree of delignification as that with chlorine.

As a pulp-bleaching method in which a first stage is carried out by using chlorine dioxide in place of chlorine, whereby the brightness of the resultant bleached pulp can be maintained constant and the amounts of chlorine dioxide and other bleaching chemicals used can be decreased, a method disclosed, for example, in J. E. Jiang et al., Appita, 45(1), 19 (1992), wherein the degree of delignification in the pulping step is enhanced, as much as possible, to decrease the Kappa number of the unbleached pulp; a method as disclosed in, for example, Japanese Unexamined Patent Publication No. 4-316,690, in which an alkali-oxygen delignification is promoted by using a pre-treatment chemical, for example, nitrous acid, to reduce the Kappa number of the pulp; a method as disclosed in, for example, Japanese Unexamined Patent Publication No. 2-264,087, in which, before a multi-stage bleaching step, a pulp is treated with a xylan-decomposition enzyme; and a method disclosed in, for example, Japanese Unexamined Patent Publication No. 4-316,689, wherein, before a multi-stage bleaching treatment step, a pulp is treated with a lignin-decomposition enzyme, are known.

The methods mentioned above should be further improved. For example, the method in which the delignification degree in the pulping step is enhanced from the conventional degree to decrease the Kappa number of the pulp is usually disadvantageous in a decrease in the pulp yield and in a decrease in the mechanical strength of the pulp fibers.

The method in which the delignification degree of a pulp in an alkali-oxygen delignification stage is enhanced to decrease the Kappa number of the resultant pulp is disadvantageous in that usually there is a risk of a decrease in the mechanical strength of the pulp. Further, the methods wherein, before the bleaching treatment step, the pulp is pre-treated with an enzyme are advantageous in that the reaction conditions are relatively medium and thus the increases in the mechanical strength of the pulp and in the pulp yield are small and disadvantageous in that the reaction velocity is low and thus a long treatment time is necessary.

The inventors of the present invention have provided a pulp-bleaching method in which an alkali-oxygen-delignified pulp is treated with an acid in an oxygen-containing gas under pressure, whereby the amount of the bleaching chemicals used for the bleaching step can be significantly reduced, and have reported that the acid treatment of the alkali-oxygen delignified pulp in the oxygen-containing gas under pressure can cause the amount of chlorine dioxide used in a first stage of the bleaching step to be reduced to 80% of that in the conventional method.

Also, the inventors of the present invention have provided a pulp-bleaching method in which an alkali-oxygen-delignified pulp is treated with an acid, in a nitrogen-containing gas under pressure, whereby the amount of the bleaching chemicals to be used in the bleaching step can be reduced, and have reported that the acid treatment can cause the amount of chlorine dioxide used in the first stage of the bleaching step to be reduced to about 55% of that in the conventional bleaching method. However, in the method in which the acid treatment causes the amount of the bleaching chemicals in the bleaching step to be reduced, an acid treatment step must be added to the bleaching step and thus the procedure for producing a bleached pulp is prolonged.

A method in which the efficiency of the chlorine dioxide-bleaching step is enhanced by improving the chlorine dioxide-bleaching procedure per se is known. Tappi Jurnal, 75(7), 1992, pages 174 to 180 reports that in a C/E/D/E/D sequence bleaching method, when an initial stage of 5 to 15 minutes, if an chlorine dioxide-bleaching step, was carried out at a pH value of 5 to 10 of an aqueous pulp slurry, and then the remaining stage for 2.5 hours or more was carried out at a pH value of 1.7 to 4.4, a bleached pulp having a desired brightness could be obtained in an amount of chlorine dioxide used in the bleaching step less than that in the conventional method. In the bleaching sequence, C represent a chlorine bleaching, E represents an extraction, and D represents a chlorine dioxide bleaching.

This method is disadvantageous in that this method exhibits no effect for a pulp having a Kappa number of 10 or more, and cannot be applied to an initial chlorine dioxide bleaching stage.

1987 Pulping Conference Proceedings, page 487 reports that in later step of a bleaching method, chlorine dioxide is added in two or more separate stages and in each adding stage, an alkali is also added, to enhance the chlorine dioxide bleaching efficiency. This bleaching method is, however, disadvantageous in that the bleaching method per se is complicated and cannot be applied to an initial chlorine dioxide-bleaching step.

Journal of Pulp and Paper Science, Vol. 22, No. 12, Pages 457 to 463 (1996) reports that in the chlorine dioxide bleaching method, the amount of AOX produced in the chlorine dioxide-bleaching procedure may increase in response to the chlorine dioxide bleaching conditions. Therefore, in the improvement of the chlorine dioxide bleaching method, an increase in the AOX amount should be prevented.

SUMMARY OF THE INVENTION

An object of the present invention is to provide a method of producing a bleached pulp in which a delignify-bleaching efficiency of chlorine dioxide bleaching for a pulp obtained from a lignocellulosic substance is improved, the necessary amount of the bleaching chemicals for bleaching the pulp into a desired brightness is reduced, and the amount of AOX in the waste water can be decreased.

The above-mentioned object can be attained by the method of the present invention for producing a bleached pulp, which comprises:

preparing a pulp from a lignocellulosic material; and subjecting an aqueous slurry of the pulp to a bleaching step including at least one stage in which the pulp is bleached with chlorine dioxide under a pressure created by a compressed gas.

In the bleached pulp-producing method of the present invention, the compressed gas preferably comprises at least one member selected from the group consisting of oxygen, nitrogen, carbon dioxide, argon, helium and air, especially the compressed gas comprises a member selected from the group consisting of oxygen-rich gases and nitrogen-rich gases.

In the bleached pulp-producing method of the present invention, the chlorine dioxide-bleaching is preferably carried out in a gauge pressure range of from 0.147 to 0.785 MPa (1.5 to 8.0 kg/cm$^2$).

In the bleached pulp-producing method of the present invention, the pulp-preparing step is preferably carried out in such a manner that the lignocellulosic material is subjected to a chemical pulping procedure and the resultant chemical pulp is delignified by an alkali-oxygen delignification procedure.

Also, in the bleached pulp-producing method of the present invention, the bleaching step is preferably carried out in multi-stages at least one of which is chlorine dioxide-bleaching stage under a pressure created by a compressed gas. In this case, the chlorine dioxide-bleaching procedure under a pressure created by a compressed gas is preferably carried out at the initial stage of the multi-stage bleaching step.

In the bleached pulp-producing method of the present invention, preferably the chlorine dioxide-bleaching stage is carried out at a pH value of 2 to 5, at a temperature of 50 to 120° C. and in a pulp consistency of 5 to 40% by weight of the aqueous pulp slurry for 5 to 180 minutes.

DESCRIPTION OF THE PREFERRED EMBODIMENTS

The inventors of the present invention have made various attempts to provide a method of bleaching a pulp prepared from a lignocellulosic material with chlorine dioxide with an enhanced efficiency. As a result, it has been found that a bleaching procedure of the pulp with chlorine dioxide under a pressure created by a compressed gas enables the delignification-bleaching efficiency of the chlorine dioxide bleaching procedure to be significantly enhanced and the AOX amount in the waste water from the chlorine dioxide bleaching procedure to be significantly reduced. The present invention has been completed on the basis of the finding.

In the bleached pulp-producing method of the present invention, preferably, the lignocellulosic material is selected from softwood materials and hardwood materials. However, non-wood lignocellulosic materials, for example, kenaf, jute, hemp, flax, ramie bagasse and rice straw, may be used as a lignocellulosic material for the method of the present invention. The pulp usable for the present invention is preferably a chemically cooked pulp, namely a chemical pulp. Mechanical pulp is, however, usable for the method of the present invention. Also, the pulp usable for the present invention includes used paper pulp made from the above-mentioned pulps.

In the bleached pulp-producing method of the present invention, an aqueous slurry of the pulp is subjected to a bleaching procedure in at least one stage of which, the pulp is bleached with chlorine dioxide under a pressure created by a compressed gas. The bleaching gauge pressure created by the compressed gas is preferably in the range from 0.0980 to 0.883 MPa (1.0 to 9.0 kg/cm$^2$), more preferably 0.147 to 0.785 MPa (1.5 to 8.0 kg/cm$^2$), still more preferably 0.196 to 0.686 MPa (2.0 to 7.0 kg/cm$^2$).

The compressed gas for creating a necessary pressure for the chlorine dioxide bleaching system is not limited to specific types of gases. Namely, the compressed gas comprises at least one member selected from, for example, oxygen, nitrogen, carbon dioxide and air. The compressed gas may comprises a member selected from oxygen-rich gases and nitrogen-rich gases. The term "oxygen-rich gas" refers to a gas containing oxygen in a content of 21% by volume or more, preferably 85% by volume or more. Also, the term "nitrogen-rich gas" refers to a gas containing nitrogen in a content of 95% by volume or more.

In the method of the present invention, when an oxygen-rich gas is used as a compressed gas under a pressure, the amount of the bleaching chemical necessary to obtain a desired bleaching result may be reduced. Also, when nitrogen gas is used as a compressed gas under a pressure, the resultant bleached pulp is advantageous in that the mechanical strength of the resultant bleached pulp fibers is excellent, while the reduction in the amount of the bleaching chemicals is smaller than that in the use of the oxygen-rich gas. From an economical point of view, an oxygen-rich gas produced by a deep cooling isolation method for an alkali-oxygen bleaching procedure, an oxygen-rich gas produced by a pressure swing absorption (PSA) method or an oxygen-rich gas produced by a vacuum swing absorption (VAS) method, or a nitrogen-rich gas produced as a by-product of the above-mentioned oxygen-rich gas-production methods are advantageously utilized for the method of the present invention.

In the chlorine dioxide-bleaching procedure, when the bleaching gauge pressure is less than 0.098 MPa (1.0 kg/cm$^2$), the effect of the pressure on the bleaching result may be unsatisfactory. Also, when the bleaching gauge pressure is more than 0.883 MPa (9.0 kg/cm$^2$), the effect of the pressure on the bleaching result may be saturated, the cost of the bleaching reactor usable under the high pressure is very high, and an economical disadvantage may occur.

In the chlorine dioxide bleaching procedure in accordance with the present invention, the pulp consistency of the aqueous pulp slurry is preferably 5 to 40% by weight, more preferably 8 to 35% by weight, still more preferably 10 to 25% by weight. When the pulp consistency is less than 5% by weight, a bleaching apparatus having a very large capacity may be necessary and thus an economical disadvantage may occur. When the pulp consistency is more than 40% by weight, a uniform mixing of the pulp with chlorine dioxide may be difficult and the effect of the chlorine dioxide treatment on the pulp may be insufficient.

To obtain a high treatment effect of the chlorine dioxide bleaching procedure in accordance with the present invention the pulp must be uniformly mixed with chlorine dioxide. To obtain the uniform mixing, a conventional mixer is selected from low consistency mixers, medium consistency mixers, static mixers and high consistency mixers and is used under appropriate conditions in response to the type and consistency of the pulp in the aqueous slurry thereof. The mixing operation can be effected in the similar manner to that for the alkali-oxygen delignification procedure.

Namely, where the consistency of the pulp in the aqueous pulp slurry supplied to the chlorine dioxide bleaching procedure is medium or high, the mixing of the pulp slurry may be difficult. In this case, preferably a medium or high consistency mixer, which can apply a high shearing force to the pulp, is used together with or without a disperser, to instantly mix the pulp with the compressed gas and the chlorine dioxide, and immediately, the resultant mixture is introduced into a reaction column and is maintained at a desired temperature for a desired time. The reaction column for a chlorine dioxide treatment of the pulp in a medium consistency may be selected from continuous down-flow or up flow-type reaction columns which may be equipped or not equipped with a distributor and a discharger.

The reaction column for the chlorine dioxide treatment of a high consistency pulp is preferably selected from vertical down-flow type reaction columns which have trays each having one hole through which the pulp can fall down from a tray to an other tray by means of horizontally rotating wings; and Pandia type reaction columns which have a plurality of pressure-resistant horizontal tubes, and in which the pulp is horizontally moved by gradually rotating a screw for transporting the pulp, and the pulp is transported from an end of a tube to the next tube and finally is discharged from the tube.

In the method of the present invention, the chlorine dioxide bleaching procedure is preferably carried out at a pH value of the aqueous pulp slurry of 2 to 5, more preferably 2.5 to 4.0. When the pH value is less than 2.0, the polysaccharides in the pulp may be significantly decomposed and thus the resultant bleached pulp may exhibit a decreased mechanical strength and a reduced yield. Also, when the pH value is more than 5, the delignification and bleaching reactions may be insufficient even under pressure. In the method of the present invention, the pH value of the aqueous pulp slurry can be adjusted by conventional methods, namely by adding a known acid or alkali. The pH-adjusting acid in preferably consists of sulfuric acid and the pH-adjusting alkali preferably consists of sodium hydroxide which acid and alkali are easily available and handled. Of course, when the pH value of the bleaching system reaches the desired value when the chlorine dioxide is added, the pH value adjustment with the acid or alkali is unnecessary.

In the method of the present invention, the chlorine dioxide bleaching procedure is preferably carried out at a temperature of 50 to 120° C., more preferably 90 to 100° C. for a bleaching time, in which the above-mentioned temperature is maintained, of 5 to 180 minutes, more preferably 20 to 90 minutes. When the bleaching temperature is less than 50° C., the delignification and bleaching result may be unsatisfactory, and when the bleaching temperature is more than 120° C., the decomposition of the polysaccharides may occur significantly and thus the reduction in the mechanical strength of the pulp may be too high. When the bleaching time is 5 minutes or more, the bleaching effect may be satisfactory. However, when the bleaching time is more than 180 minutes, the delignification and bleaching effect may be saturated and the physical properties of the resultant pulp may be deteriorated.

In the chlorine dioxide bleaching procedure in accordance with the method of the present invention, the amount of the chlorine dioxide in the bleaching system is established in consideration of the Kappa number, brightness, type and other physical properties of the pulp and the bleaching conditions of other bleaching stages. Usually, the amount of chlorine dioxide is 0.2 to 2% in terms of active chlorine.

The chlorine dioxide bleaching system for the method of the present invention is optionally added with an auxiliary comprising at least one member selected from, for example, peroxide compounds, acetone and methyl alcohol. The addition of the peroxide compound contributes to enhancing the bleaching effect in the later bleaching stage. On other hand, the addition of the peroxide compound may cause the viscosity of the resultant pulp to decrease. Therefore, the amount of the added peroxide compound should be less than 1% by weight. The bleaching sequence in the method of the present invention may include not only one but also two or more chlorine dioxide bleaching stages.

In a preferable embodiment of the method of the present invention, a chemical pulp is prepared from a lignocellulosic material, and then subjected to an alkali-oxygen delignification treatment, and then the resultant delignified pulp is fed into an initial stage of a multi-stage bleaching step.

The cooking procedure for preparing the chemical pulp can be selected from conventional cooking procedures, for example, kraft, polysulfide, soda, and alkali sulfide cooking procedures. Among these cooking procedures, in consideration of the quality of the resultant pulp and also the energy efficiency, the kraft cooking procedure is advantageously applied to the method of the present invention.

For example, when a wood material is cooked by the kraft cooking procedure, preferably, the sulfidity of the kraft cooking liquid is 5 to 75%, more preferably 15 to 45% by weight, the content of effective alkali is 5 to 30%, more preferably 10 to 25% by weight based on the bone dry weight of the wood material, and the cooking temperature is 140 to 170° C. The kraft cooking procedure is carried out by a continuous cooking method or a batch type cooking method. When a continuous cooking reactor is used, the continuous procedure may be carried out by any conventional method, for example, a modified cooking method in which the composition of the cooking liquor is corrected at a plurality of stages.

In the cooking procedure of the present invention, the cooling liquor preferably contains a cooking additive comprising at least one member selected from conventional cyclic keto compounds, for example, benzoquinone, naphthoquinone, anthraquinone, anthrone, phenanthoroquinone, and cyclic nucleus-substituted compounds of the above-mentioned quinone compounds with substituent groups, for example alkyl and amino groups; hydroquinone compounds corresponding to reduction products of the quinone compounds, for example, anthrahydroquinone; and stable compounds, for example, 9,10-diketohydroanthracene compounds, produced, as intermediates, by a anthraquinone synthesis in accordance with a Diels-Alder method. The cooking additive is preferably used in an amount of 0.001 to 1.0% by weight based on the bone dry weight of the wood material.

In the method of the present invention, the unbleached pulp delivered from the cooking procedure is washed with water, coarsely screened and then finely screened. The finely screened pulp is optionally subjected, to a conventional delignification procedure with oxygen in an aqueous alkali solution. The alkali-oxygen delignification procedure can be carried out at a medium or high consistency. Usually, the alkali-oxygen delignification procedure is preferably carried out by the common medium consistency method at a pulp consistency of 8 to 15% by weight.

The alkali usable for the alkali-oxygen delignification in the medium consistency is preferably selected from an aqueous sodium hydroxide solution or an oxidized kraft white liquor. An oxygen gas and an alkali are added into a medium consistency pulp slurry and fully mixed in a medium consistency mixer. Then the pulp-oxygen-alkali mixture is fed into a delignification reactor in which the mixture is held for a certain time, and the delignification reaction is carried out. The medium consistency mixer, of which the constitution depends on the manufacturers, has a rotor capable of rotating at a high speed of 500 to 1000 rpm, and can impart a high shearing force to the medium consistency pulp slurry so as to allow the pulp slurry to behave as a fluid such as water, and thus the pulp is fully mixed with the oxygen and the alkali.

In the pulp slurry, preferably the content of oxygen is 0.5 to 3% by weight based on the bone dry weight of the pulp, and the content of the alkali is 0.5–4% by dry weight based on the bone dry weight of the pulp. Also, preferably, the reaction temperature is 80 to 120° C., the reaction time is 15 to 100 minutes and the pulp consistency is 8 to 15% by weight. The above-mentioned delignification conditions usable for the present invention include the conventional alkali-oxygen delignification conditions.

The alkali oxygen-delignified pulp is washed with water and then fed to the bleaching step, in accordance with the present invention, to thereby bleach the pulp.

In the method of the present invention, the bleaching step includes at least one stage in which the pulp is bleached with chlorine dioxide under a pressure created by a compressed gas.

The bleaching step of the present invention consists of one or more chlorine dioxide bleaching stages under pressure alone or consists of one or more chlorine dioxide bleaching stages under pressure and one or more other bleaching stages. The later will be referred to as a multi-stage bleaching step hereinafter.

In the multi-stage bleaching step of the method of the present invention, the bleaching chemicals other than chlorine dioxide include sodium hydroxide (E), oxygen (O), hydrogen peroxide (P), ozone (Z) and organic peracids which are conventional bleaching chemicals other than chlorine. These chemicals may be used alone or in a mixture thereof. Also, the bleaching chemicals usable for the present invention may include xylan-decomposing enzymes, and lignin-decomposing enzymes (Ez). Further, the conventional chlorine dioxide bleaching procedure (D) under the ambient air pressure may be included in the multi-stage bleaching step.

In the multi-stage bleaching step in the method of the present invention can be carried out in the following sequences.

$D_1$/O-E/O-$D_2$,
$D_1$/N-E/O-$D_2$,
$D_1$/O-E/O-$D_2$/O,
$D_1$/N-E/O-$D_2$/O,
$D_1$/O-E-$D_2$,
$D_1$/O-E/OP-$D_2$,
$D_1$/O-Z-$D_2$,
Ez-$D_1$/O-E/O-$D_2$

In the above-mentioned bleaching sequences, $D_1$/O refers to a first chlorine dioxide bleaching stage under a pressure created by a compressed oxygen gas, E/O refers to a sodium hydroxide-oxygen bleaching stage, $D_2$ refers to a second chlorine dioxide bleaching stage under ambient air pressure, $D_1$/N refers to a first chlorine dioxide bleaching stage under a pressure created by a compressed nitrogen gas, $D_2$/O refers to a second chlorine dioxide bleaching stage under a pressure created by a compressed oxygen gas, E refers to a sodium hydroxide treatment stage, E/OP refers to a sodium hydroxide-oxygen-hydrogen peroxide bleaching stage, Z refers to an ozone bleaching stage, and Ez refers to an enzyme bleaching stage. The bleaching step in the method of the present invention may comprise one or more chlorine dioxide bleaching stages under a pressure created by a compressed gas and one or more conventional bleaching or alkali treating stages. The conventional stage may include oxygen bleaching, alkali-oxygen bleaching, ozone bleaching and enzyme bleaching stages.

The method of the present invention is advantageous in that when the bleaching step is carried out in multi stages comprising, in addition to at least one chlorine dioxide bleaching stage under a pressure created by a compressed gas, at least one other bleaching stage such as an E/O, E/P or E/OP stage in which an oxidation chemical selected from oxygen (O) and hydrogen peroxide (P) is added to the alkali extraction procedure (E), the resultant bleached pulp exhibits an enhanced brightness. The alkali-extraction stage added with oxygen and/or hydrogen peroxide may be carried out under a pressure similar to that of the alkali-oxygen delignification procedure, or may be carried out in such a manner that in an initial 5 to 15 minutes of the stage, the pressure is applied and thereafter the applied pressure is released and the remaining portion of the alkali extraction procedure in the presence of oxygen and/or hydrogen peroxide is carried out under the ambient air pressure.

The reasons why the chlorine dioxide bleaching under the pressure created by the compressed gas can improve the efficiency of the delignification and bleaching are not clear at the present time and should be made clear by the studies is the future. The reasons are assumed, however, to be that the delignification and bleaching reaction of the pulp with chlorine dioxide is accelerated by the pressure applied to the reaction system, and the pulp fibers per se are changed in structure and properties thereof by the application of the pressure so as to promote the delignification and bleaching of the pulp fibers.

When the bleaching pressure is created by a compressed oxygen-rich gas, the oxygen gas per se participates in the delignification and bleaching reaction so as to promote the reaction, and thus the amount of the chlorine dioxide to be added to the reaction system can be reduced. On other hand, when the compressed nitrogen-rich gas is used to create the pressure in the reaction system, the generation of radical groups due to the chlorine dioxide bleaching is hindered, the decomposition of the cellulose in the pulp fibers due to the radical groups is restricted, and thus the resultant bleached pulp has a high mechanical strength.

EXAMPLES

The present invention will be further illustrated by the examples in comparison with comparative examples. However, the present invention is not limited by the examples in any way.

In Examples 1 to 4 and Comparative Example 1, an unbleached pulp prepared by cooking wood chips was delignified with oxygen in an aqueous alkali solution, and then bleached in a bleaching sequence $D_1$/O-E-$D_2$, $D_1$/N-E-$D_2$, $D_1$-E-$D_2$/O, $D_1$/O-E-$D_2$/O, or $D_1$-E-$D_2$ which contained an E stage.

In Example 5 and Comparative Example 2, the alkali-oxygen delignified pulp was bleached in a bleaching sequence $D_1$/O-E/O-$D_2$ or $D_1$-E/O-$D_2$ which contained an E/O stage.

Unless specifically indicated, the reduction in the amount of chemical used in the two chlorine dioxide bleaching stages and in the single alkali treatment stage and the pulp yield in the multi-stage bleaching procedure were calculated in the manners as shown below. Also, the brightness of the bleached pulp and the viscosity of the pulp, and the content of AOX in the waste water were determined by the measurements as shown below. Further, the amounts of the chemicals used in the examples and comparative examples are shown in % by weight based on the bone dry weight of the pulp.

(1) Reduction in Total Amount of Chemicals Used in the Two Chlorine Dioxide Bleaching Stages The reduction in total amount of the chemical (chlorine dioxide) used in the chlorine dioxide bleaching stages, namely the $D_1$, $D_1$/O or $D_1$/N stage and the $D_2$ or $D_2$/O stage, was calculated in accordance with the equation (1).

Equation (1):

[A reduction (%) in the total amount of chlorine dioxide used in two chlorine dioxide bleaching stages]=[{(A total amount of chlorine dioxide used in the two chlorine dioxide bleaching stages both using no compressed gas)−(A total amount of chlorine dioxide used in the two chlorine dioxide bleaching stages in at least one of which a compressed gas was used)}/(A total amount of chlorine dioxide used in the two chlorine dioxide bleaching stages both using no compressed gas)×100]

(2) Reduction in the Amount of Chemical (sodium hydroxide) Used in the E or E/O Stage A reduction in the amount of the chemical, sodium hydroxide used in the E or E/O stage was calculated in accordance with the equation (2).

Equation (2):

[A reduction (%) in the total amount of sodium hydroxide used in the E or E/O stage]=[{(A total amount of sodium hydroxide used in E or E/O stage when the two chlorine dioxide bleaching stages were carried out both by using no compressed gas)−(A total amount of sodium hydroxide used in the E or E/O stage when the two chlorine dioxide bleaching stages are carried out by using a compressed gas in at least one of the two bleaching stages)}/(A total amount of sodium hydroxide used in the E or E/O stage when the two chlorine dioxide bleaching stages were carried out both by using no compressed gas)×100]

(3) Pulp Yield in Multi-stage Bleaching Step

In a multi-stage bleaching step, a yield of pulp was calculated from the weights of pulp before and after the multi-stage bleaching step in accordance with the equation (3) shown below.

Equation (3)

[Pulp yield in multi-stage bleaching step (%)]=[{(A bone dry weight of pulp after multi-stage bleaching step)/(A bone dry weight of pulp before multi-stage bleaching step)}×100]

(4) Measurement of Pulp Brightness

A pulp was disintegrated, and then formed into a pulp sheet having a basis weight of 60 g/$m^2$, in accordance with Tappi testing method T 205 os-71 (JIS P8209). Then the brightness of the pulp sheet was measured in accordance with JIS P8123.

(5) Measurement of Pulp Viscosity

A pulp viscosity was measured in accordance with J. Tappi 44.

(6) Measurement of AOX

The amount of AOX in the waste water from the bleaching step was measured by using a halogen analyzer TOX-10 made by Mitsubishi Kaseikogyo K.K.). The AOX amount was indicated in a bone dry weight (kg) of AOX per ton of the air dry weight of the resultant pulp, namely in kg/ADt.

Example 1

Bleaching Sequence: $D_1$/O-E-$D_2$

Hardwood-mixed wood chips comprising 70% of Japanese hardwood chips and 30% of Eucalyptus wood chips and in a bone dry weight of 500g were kraft-cooked in a cooking liquid comprising 18% of effective alkali based on the bone dry weight of the wood chips and having a degree of sulfide of 25% in a liquor ratio of 4 at a cooking temperature of 160° C. for a cooking time of 120 minutes in an indirect heating type laboratory autoclave. The resultant pulp was isolated from the waste liquor, and screened through a flat screen equipped with a 10 cut screen plate. An unbleached hardwood kraft pulp having a Hunter brightness of 45.2%, a Kappa number of 20.1 and a pulp viscosity of 23.3 mPa·s was obtained in an amount of 229 g. The yield of the screened pulp was 45.8%.

The unbleached hardwood kraft pulp in a bone dry weight of 90.0 g was added with sodium hydroxide in an amount of 1.5% based on the bone dry weight of the pulp, the mixture was diluted with ion-exchanged water to provide an aqueous pulp slurry having a pulp consistency of 10%. The pulp slurry was placed in an indirect heating type autoclave and pressurized to a gauge pressure of 0.490 MPa (5 kg/cm$^2$) by introducing a compressed trade oxygen gas having a degree of purity of 99.9% into the autoclave. Then, the pulp slurry was heated at a temperature of 100° C. under the above-mentioned gauge pressure for 60 minutes, to delignify the pulp with oxygen in an aqueous alkali solution by a medium consistency delignification method.

The resultant delignified pulp was washed with ion-exchanged water, and dewatered. The resultant pulp in a bone dry weight of 88.8 g had a brightness of 51.1%, a Kappa number of 10.2 and a pulp viscosity of 18.8 mPa·s.

The resultant pulp in a bone dry weight of 80.0 g was suspended in a pulp consistency of 10% in an aqueous sulfuric acid solution prepared by dissolving a concentrated sulfonic acid in ion-exchanged water and having a pH value of 2.5. The pulp slurry was added with chlorine dioxide in an amount of 0.46% based on the bone dry weight of the pulp. The chlorine dioxide-containing pulp slurry was placed in an indirect-heating type stainless steel autoclave having a capacity of 2 liters, pressurized to a gauge pressure of 0.490 MPa (5 kg/cm$^2$) by introducing a trade compressed oxygen gas having a degree of purity of 99.9%, and then bleached at a temperature of 95° C. for 60 minutes, while the bleaching pressure is maintained at the above-mentioned level, to effect a chlorine dioxide bleaching ($D_1$/O stage) under a pressure created by the compressed oxygen gas. After the bleaching procedure was completed, the autoclave was cooled, and the resultant pulp was washed with ion-exchanged water and dewatered.

The above-mentioned $D_1$/O stage-treated pulp was placed in a plastic sheet bag and then suspended in ion-exchanged water to adjust the pulp consistency in water to 10%. Then the aqueous pulp slurry in the bag was added with sodium hydroxide in an amount of 0.74% based on the bone dry weight of the pulp. The bag was immersed in a constant temperature water bath at a temperature of 70° C. for 120 minutes, to effect an alkali-extraction treatment (E stage). The resultant pulp was removed from the aqueous alkali solution and washed with ion-exchanged water and dewatered.

Then, the resultant alkali-extracted pulp was placed in a plastic bag and suspended in ion-exchanged water to provide an aqueous pulp slurry having a pulp consistency of 10%. The pulp slurry was added with chlorine dioxide in an amount of 0.4% based on the bone dry weight of the pulp. The chlorine dioxide-containing pulp slurry was heated at a temperature of 70° C. for 100 minutes in the same manner as in the E stage, to effect the $D_2$-bleaching stage under the ambient atmospheric pressure.

The resultant bleached pulp was washed with ion-exchanged water and dewatered. The resultant pulp had a bone dry weight of 78.6 g and had a pulp brightness of 85.4%, and a pulp viscosity of 16.2 mPa·s.

The total amount of chlorine dioxide used in the $D_1$/O stage and the $D_2$ stage, the reduction in the total amount of chlorine dioxide used in the $D_1$/O and $D_2$ stages, the reduction in the amount of sodium hydroxide used in the E stage, the pulp yield in the $D_1$/O-E-$D_2$ sequence bleaching step, and the brightness and viscosity of the bleached pulp are shown in Table 1. Also, the amount of AOX in the waste water from the $D_1$/O-E-$D_2$ sequence bleaching step is shown in Table 2.

Example 2

Bleaching Sequence: $D_1$/N-E-$D_2$

The same alkali-oxygen delignified pulp having a brightness of 51.1%, a Kappa number of 10.2 and a pulp viscosity of 18.8 mPa·s as in Example 1 was suspended in an amount of 80 g in aqueous sulfuric acid solution prepared by dissolving a concentrated sulfuric acid in ion-exchanged water and having a pH value of 2.5, to provide an acid pulp slurry having a pulp consistency of 10%. The acid pulp slurry was added with chlorine dioxide in an amount of 0.51% based on the bone dry weight of the pulp, and placed in an indirect heating type stainless steel autoclave having a capacity of 2 liters. The acid pulp slurry was pressurized to a gauge pressure of 0.490 MPa (5 kg/cm$^2$) by introducing a trade compressed nitrogen gas having a degree of purity of 99.9% into the autoclave, and heated at a temperature of 95° C. for 60 minutes while maintaining the bleaching pressure at the above-mentioned level. A chlorine dioxide bleaching stage under a pressure created by a compressed nitrogen gas, namely a $D_1$/N stage, was carried out. After the autoclave was cooled, the resultant pulp was washed with ion-exchanged water and dewatered.

The $D_1$/N stage-bleached pulp was placed in a plastic bag and suspended in ion-exchanged water to provide an aqueous pulp slurry having a pulp consistency of 10%. Then, to the pulp slurry was added sodium hydroxide in an amount of 0.82% based on the bone dry weight of the pulp. The bag was immersed in a constant temperature water bath at a temperature of 70° C. for 120 minutes to apply an alkali treatment (the E stage) to the pulp. The resultant alkali-treated pulp was washed with ion-exchanged water and dewatered.

The alkali-treated pulp was placed in a plastic bag and suspended in ion-exchanged water to provide a pulp slurry having a pulp consistency of 10%. To the pulp slurry was added chlorine dioxide in an amount of 0.4% based on the bone dry weight of the pulp. The chlorine dioxide-containing pulp slurry was heated at a temperature of 70° C. for 180 minutes in the same manner as in the E stage, to apply a $D_2$ bleaching treatment to the pulp.

The resultant bleached pulp was washed with ion-exchanged water and dewatered. A bleached pulp was obtained in an amount of 78.7 g and had a brightness of 85.5% and a pulp viscosity of 17.1 mPa·s.

The total amount of chlorine dioxide used in the $D_1$/N stage and the $D_2$ stage, the reduction in the total amount of chlorine dioxide used in the $D_1$/N stage and the $D_2$ stage, the reduction in the amount of sodium hydroxide used in the E stage, the pulp yield in the multi-stage bleaching step, and the brightness and viscosity of the bleached pulp are shown in Table 1.

Also, the amount of AOX in the waste water from the bleaching step in the $D_1$/N-E-$D_2$ bleaching sequence is shown in Table 2.

Example 3

Bleaching Sequence: $D_1$-E-$D_2$/O

The same alkali-oxygen delignified pulp having a brightness of 51.1%, a Kappa number of 10.2 and a pulp viscosity of 18.8 mPa·s as in Example 1 was placed in an amount of 80 g in a plastic bag and suspended in aqueous sulfuric acid solution prepared by dissolving a concentrated sulfuric acid in ion-exchanged water and having a pH value of 2.5, to provide an acid pulp slurry having a pulp consistency of 10%. The acid pulp slurry was added with chlorine dioxide in an amount of 0.60% based on the bone dry weight of the pulp, and the bag was immersed in constant temperature water bath at a temperature of 95° C. for 60 minutes, to effect the $D_1$ stage bleaching.

The resultant pulp was washed with ion-exchanged water and dewatered.

The $D_1$ stage-bleached pulp was placed in a plastic bag and suspended in ion-exchanged water to provide an aqueous pulp slurry having a pulp consistency of 10%. Then, to the pulp slurry was added sodium hydroxide in an amount of 0.96% based on the bone dry weight of the pulp. The bag was immersed in a constant temperature water bath at a temperature of 70° C. for 120 minutes to apply an alkali treatment (the E stage) to the pulp. The resultant alkali-treated pulp was washed with ion-exchanged water and dewatered.

The alkali-treated pulp was suspended in ion-exchanged water to provide a pulp slurry having a pulp consistency of 10%. To the pulp slurry was added chlorine dioxide in an amount of 0.4% based on the bone dry weight of the pulp. The chlorine dioxide-containing pulp slurry was placed in an indirect heating type stainless steel autoclave having a capacity of two liters. The pulp slurry in the autoclave was pressurized to a gauge pressure of 0.490 MPa (5 kg/cm$^2$) by introducing a trade compressed oxygen gas having a degree of purity of 99.9% into the autoclave, and heated at a temperature of 70° C. for 180 minutes while maintaining the bleaching pressure at the above-mentioned level, to effect a chlorine dioxide bleaching stage under a pressure created by a compressed oxygen gas, namely the $D_2$/O stage. After the autoclave cooled, the resultant pulp was washed with ion-exchanged water and dewatered. The resultant bleached pulp had a bone dry weight of 78.6 g and had a brightness of 85.3% and a pulp viscosity of 16.5 mPa·s.

The total amount of chlorine dioxide used in the $D_1$ stage and the $D_2$/O stage, the reduction in the total amount of chlorine dioxide used in the $D_1$ stage and the $D_2$/O stage, the reduction in the amount of sodium hydroxide used in the E stage, the pulp yield in the multi-stage bleaching step, and the brightness and viscosity of the bleached pulp are shown in Table 1.

Also, the amount of AOX in the waste water from the bleaching step in the $D_1$-E-$D_2$/O bleaching sequence is shown in Table 2.

Example 4

Bleaching Sequence: $D_1$/O-E-$D_2$/O

The same alkali-oxygen delignified pulp having a brightness of 51.1%, a Kappa number of 10.2 and a pulp viscosity of 18.8 mPa·s as in Example 1 and in an amount of 80 g was subjected to the same $D_1$/O stage treatment and then to the same E stage treatment as those in Example 1.

The resultant pulp was washed with ion-exchanged water and dewatered.

The $D_1$/O-E stage-treated pulp was suspended in ion-exchanged water to provide an aqueous pulp slurry having a pulp consisting of 10%. Then, to the pulp slurry was added chlorine dioxide in an amount of 0.25% based on the bone dry weight of the pulp.

The chlorine dioxide-containing pulp slurry was placed in an indirect heating type stainless steel autoclave having a capacity of two liters, pressurized to a gauge pressure of 0.490 MPa (5 kg/cm$^2$) by introducing a trade compressed oxygen gas having a degree of purity of 99.9%, and then heated at a temperature of 70° C. for 180 minutes while maintaining the bleaching pressure at the above-mentioned level, to effect a chlorine dioxide bleaching stage treatment under a pressure created by a compressed oxygen gas, namely the $D_2$/O stage). After the autoclave was cooled, the resultant bleached pulp was washed with ion-exchanged water and dewatered. A bleached pulp was obtained in an amount of 78.5 g and had a brightness of 85.4% and a pulp viscosity of 15.9 mPa·s.

The total amount of chlorine dioxide used in the $D_1$/O stage and the $D_2$/O stage, the reduction in the total amount of chlorine dioxide used in the $D_1$/O stage and the $D_2$/O stage, the pulp yield in the multi-stage bleaching step, the reduction in the amount of sodium hydroxide used in the E stage, and the brightness and viscosity of the bleached pulp are shown in Table 1.

Also, the amount of AOX in the waste water from the bleaching step in the $D_1$/O-E-$D_2$/O bleaching sequence is shown in Table 2.

Example 5

Bleaching Sequence: $D_1$/O-E/O-$D_2$

The same alkali-oxygen delignified pulp having a brightness of 51.1%, a Kappa number of 10.2 and a pulp viscosity of 18.8 mPa·s as in Example 1 was subjected in an amount of 80 g to the same $D_1$/O stage treatment as in Example 1. The resultant bleached pulp was washed with ion-exchanged water and dewatered.

The $D_1$/O stage-treated pulp was suspended in ion-exchanged water to provide an aqueous pulp slurry having a pulp consistency of 10%. To the pulp slurry was added sodium hydroxide in an amount of 0.74% based on the bone dry weight of the pulp.

The sodium hydroxide-containing pulp slurry was placed in an indirect heating type stainless steel autoclave having a capacity of 2 liters. The alkaline pulp slurry was pressurized to a gauge pressure of 0.147 MPa (1.5 kg/cm$^2$) by introducing a trade compressed oxygen gas having a degree of purity of 99.9% into the autoclave, and heated at a temperature of 70° C. for 15 minutes while maintaining the alkali-treating pressure at the above-mentioned level, then the alkali-treating pressure was reduced to the ambient atmospheric pressure (the gauge pressure=0), the pulp slurry was further heated at a temperature of 70° C. for 105 minutes to carry out an alkali-extraction treatment in the presence of oxygen, namely the E/O stage.

The resultant pulp was washed with ion-exchanged water and dewatered. The alkali-extraction treated pulp was subjected to the same $D_2$ stage treatment as in Example 1, except that the amount of chlorine dioxide was changed to 0.22% based on the bone dry weight of the pulp. The resultant bleached pulp was in a bone dry weight of 78.5 g and had a brightness of 85.4% and a pulp viscosity of 15.8 mPa·s.

The total amount of chlorine dioxide used in the $D_1$/O stage and the $D_2$ stage, the reduction in the total amount of chlorine dioxide used in the $D_1$/O stage and the $D_2$ stage, the reduction in the amount of sodium hydroxide used in the E/O stage, the pulp yield in the multi-stage bleaching step, and the brightness and viscosity of the bleached pulp are shown in Table 1.

Also, the amount of AOX in the waste water from the bleaching step in the $D_1$/O-E/O-$D_2$ bleaching sequence is shown in Table 2.

Comparative Example 1

Bleaching Sequence: $D_1$-E-$D_2$

A bleached pulp was produced by the same procedures as in Example 1 with the following exceptions.

In the bleaching $D_1$/O stage, no compressed oxygen gas was used, and chlorine dioxide was employed in an amount of 0.74% based on the bone dry weight of the pulp.

In the second alkali treatment E stage, sodium hydroxide was employed in an amount of 1.19% based on the bone dry weight of the pulp. The $D_2$ stage was carried out in the same manner as in Example 1.

The resultant pulp was washed with ion-exchanged water, dewatered and then subjected to the same chlorine dioxide bleaching $D_2$ stage treatment as in Example 1, except that chlorine dioxide was employed in an amount of 0.30% based on the bone dry weight of the pulp.

The bleached pulp was obtained in a bone dry weight of 78.4 g and had a brightness of 85.4% and a pulp viscosity of 16.1 mPa·s.

The total amount of chlorine dioxide used in the $D_1$ stage and the $D_2$ stage, the reduction in the total amount of chlorine dioxide used in the $D_1$ stage and the $D_2$ stage, the pulp yield in the multi-stage bleaching step, and the brightness and viscosity of the bleached pulp are shown in Table 1.

Also, the amount of AOX in the waste water from the bleaching step in the $D_1$-E/O-$D_2$ bleaching sequence is shown in Table 2.

TABLE 1

| Item Example No. | Chlorine dioxide: Amount in $D_1$, $D_1$/O or $D_1$N stage (*) | Chlorine dioxide: Amount in $D_2$ or $D_2$O stage (*) | Chlorine dioxide: Reduction in total amount in $D_1$, $D_1$/O or $D_1$N and $D_2$ or $D_2$/O stages | Reduction in amount of NaOH in E or E/O stage | Pulp yield (%) | Bleached pulp: Brightness (%) | Bleached pulp: Pulp viscosity (mPa.s) |
|---|---|---|---|---|---|---|---|
| Example | | | | | | | |
| 1 | 0.46 | 0.40 | 24.6 | 37.8 | 98.3 | 85.4 | 16.2 |
| 2 | 0.51 | 0.40 | 20.2 | 31.1 | 98.4 | 85.5 | 17.1 |
| 3 | 0.60 | 0.40 | 12.3 | 19.3 | 98.3 | 85.3 | 16.5 |
| 4 | 0.46 | 0.25 | 37.7 | 37.8 | 98.1 | 85.4 | 15.9 |
| 5 | 0.46 | 0.22 | 40.4 | 37.8 | 98.1 | 85.4 | 15.8 |
| Comparative Example | | | | | | | |
| 1 | 0.74 | 0.4 | — | — | 98.1 | 85.5 | 16.9 |
| 2 | 0.74 | 0.30 | 8.8 | — | 98.0 | 85.4 | 16.1 |

Note:
(*) . . . The amount (%) of chlorine dioxide is based on the bone dry weight of pulp.

The resultant bleached pulp was obtained in a bone dry weight of 78.5 g and had a brightness of 85.4% and a pulp viscosity of 16.9 mPa·s.

The total amount of chlorine dioxide used in the $D_1$ stage and the $D_2$ stage, the pulp yield in the multi-stage bleaching step, and the brightness and viscosity of the bleached pulp are shown in Table 1.

Also, the amount of AOX in the waste water from the bleaching step in the $D_1$-E-$D_2$ bleaching sequence is shown in Table 2.

Comparative Example 2

Bleaching Sequence: $D_1$-E/O-$D_2$

A bleached pulp was produced by the same procedures as in Comparative Example 1 with the bleaching exception.

The first bleaching $D_1$ stage was carried out by the same procedures as in Comparative Example 1.

The resultant pulp was washed with ion-exchanged water, dewatered and then subjected to the same alkali-oxygen extension E/O treatment as in Example 3 except that sodium hydroxide was employed in an amount of 1.19% based on the bone dry weight of the pulp.

TABLE 2

| Item Example No. | AOX content of waste water in multi-stage bleaching step (kg/ADt): $D_1$, $D_1$/O or $D_1$/N stage | E or E/O stage | $D_2$ or $D_2$/O stage | Total |
|---|---|---|---|---|
| Example | | | | |
| 1 | 0.110 | 0.011 | 0.047 | 0.168 |
| 2 | 0.129 | 0.012 | 0.047 | 0.188 |
| 3 | 0.243 | 0.008 | 0.038 | 0.289 |
| 4 | 0.110 | 0.011 | 0.028 | 0.149 |
| 5 | 0.110 | 0.007 | 0.023 | 0.140 |
| Comparative Example | | | | |
| 1 | 0.302 | 0.007 | 0.080 | 0.389 |
| 2 | 0.302 | 0.005 | 0.066 | 0.373 |

Table 1 clearly shows that the delignification and bleaching effect in the chlorine dioxide bleaching stages can be significantly accelerated by applying a pressure created by a compressed gas to the chlorine dioxide bleaching system. Also, the high pressure chloride dioxide bleaching stages significantly constitute to the production of bleached pulp having a desired high brightness with a reduced amount of bleaching chemicals, while the pulp yield of the multi stage bleaching step and the viscosity of the bleached pulp at appropriate levels for practical use. These advantages of the present invention are illustrated in Examples 1 to 4.

Especially, when the pressure is created by a compressed oxygen gas, the reduction in the amounts of the bleaching chemicals is high as shown in Examples 1, 3, 4 and 5, and when the pressure is created by a compressed nitrogen gas, the resultant bleached pulp exhibits a high pulp viscosity, whereas the reduction effect in the amounts of the bleaching chemicals is small, as shown in Example 2.

Example 5 clearly illustrates that since the bleached pulp produced by the chloride dioxide bleaching procedure under a pressure created by a compressed gas exhibits an enhanced delignification property in an alkali-extraction procedure in the presence of oxygen, the amount of the bleaching chemicals necessary to produce a bleached pulp having a desired brightness can be further reduced.

Also, Table 2 clearly shows that the specific pressure chlorine dioxide bleaching procedures in accordance with the present invention enables the AOX content of the waste water from the bleaching procedure to reduce to an extent higher than that expected from the reduction in the amount of the bleaching chemicals used.

The method of the present invention in which a chlorine dioxide bleaching procedure is carried out under a pressure created by a compressed gas can produce a bleached pulp having a desired brightness with a reduced amount of bleaching chemicals with a reduced load on waste water discharge, while the yield and pulp viscosity of the bleached pulp are maintained at appropriate levels for practical use.

What is claimed is:

1. A method of producing a bleached pulp comprising:

preparing a chemical pulp by subjecting a lignocellulosic material to a chemical pulping procedure;

delignifying the chemical pulp by an alkali-oxygen delignification procedure; and subjecting an aqueous slurry of the delignified chemical pulp to a bleaching step including at least one initial stage in which the pulp is bleached with chlorine dioxide added to the aqueous pulp slurry at a temperature of 95 to 120° C. under a gauge pressure of 0.147 to 0.785 Mpa created by a compressed gas containing oxygen in a content of 85% by volume or more.

2. The bleached pulp producing method according to claim 1, wherein the chlorine dioxide bleaching stage is carried out at a pH value of 2 to 5, and in a pulp consistency of 5 to 40% by weight of the aqueous pulp slurry for 5 to 180 minutes.

* * * * *